US009878443B2

(12) United States Patent
Smith

(10) Patent No.: US 9,878,443 B2
(45) Date of Patent: Jan. 30, 2018

(54) ADJUSTMENT ASSEMBLY FOR MARKING GAUGE

(71) Applicant: JESSEM PRODUCTS LIMITED, Orillia (CA)

(72) Inventor: Darrin E. Smith, Innisfil (CA)

(73) Assignee: JessEm Products Limited (CA)

( * ) Notice: Subject to any disclaimer, the term of this patent is extended or adjusted under 35 U.S.C. 154(b) by 157 days.

(21) Appl. No.: 14/918,259

(22) Filed: Oct. 20, 2015

(65) Prior Publication Data

US 2017/0106528 A1 Apr. 20, 2017

(51) Int. Cl.
*B25H 7/04* (2006.01)

(52) U.S. Cl.
CPC ..... *B25H 7/04* (2013.01)

(58) Field of Classification Search
CPC . G01B 3/00; G01B 3/18; G01B 5/061; G01B 5/12; G01B 7/012
USPC ..... 33/42, 44, 32.1, 32.3, 41.4, 41.3, 41.1, 33/41.6
See application file for complete search history.

(56) References Cited

U.S. PATENT DOCUMENTS 602,130 A * 4/1898 Fuller ..... B25H 7/04 33/44
2,957,248 A * 10/1960 Stedman ..... G01B 3/18 33/816
3,078,582 A * 2/1963 Bechler ..... B23Q 5/341 33/838
3,269,353 A * 8/1966 Koppelmann ..... B23Q 17/22 116/230
3,667,127 A * 6/1972 Tsugami ..... G01B 3/18 33/704
3,698,090 A * 10/1972 Parone ..... G01B 3/18 33/816
3,793,733 A * 2/1974 Nishikata ..... G01B 3/18 235/144 SS
5,197,195 A * 3/1993 Aikens ..... B25H 7/04 30/293
5,271,305 A * 12/1993 Peters ..... B26D 1/045 33/32.1
D517,931 S 3/2006 Hyde
7,269,906 B1 9/2007 Lee
8,522,445 B1 * 9/2013 Scribante ..... G01B 3/205 33/42

(Continued)

*Primary Examiner* — Yaritza Guadalupe-McCall
(74) *Attorney, Agent, or Firm* — Senniger Powers LLP

(57) ABSTRACT

A tool for acting on a workpiece includes a body and an adjustable element movably attached to the body. A tool member on the adjustable element is disposed on the adjustable element to act on the workpiece. The adjustable element is configured to move between a plurality of predetermined adjustment positions to locate a portion of the adjustable element a selected distance from the body. The adjustable element is resiliently biased against movement out of the predetermined adjustment positions. A micro adjustment mechanism provides for micro adjustment of a position of the adjustable element relative to the body once the adjustable element is moved to a selected predetermined adjustment position. The micro adjustment mechanism is configured for moving the adjustable element to an intermediate adjustment position located between the selected predetermined adjustment position and an immediately adjacent predetermined adjustment position for precise position adjustment of the adjustable element.

22 Claims, 17 Drawing Sheets

(56) References Cited

U.S. PATENT DOCUMENTS

| | | | | |
|---|---|---|---|---|
| 8,925,210 | B2 * | 1/2015 | Zhang | B25H 7/00 33/27.03 |
| 9,085,079 | B2 | 7/2015 | Manohar | |
| 2010/0024237 | A1 * | 2/2010 | Hayashida | G01B 3/18 33/831 |
| 2012/0311877 | A1 * | 12/2012 | Manohar | B25H 7/04 33/18.1 |
| 2016/0169653 | A1 * | 6/2016 | Atherton | G01B 3/18 33/817 |
| 2017/0106528 | A1 * | 4/2017 | Smith | B25H 7/04 |

* cited by examiner

ADJUSTMENT ASSEMBLY FOR MARKING GAUGE

FIELD

The present invention generally relates to an adjustment assembly for a tool and more particularly to a marking gauge adjustment assembly.

BACKGROUND

Marking gauges are well known in the art of wood working. A marking gauge may be used to scribe or mark a line in a workpiece for cutting the workpiece along the scribed line. Conventional marking gauges include a stock or fence and a scribing bar that can be adjusted relative to the fence. Precise adjustment of the scribing bar in conventional marking gauges can be difficult as conventional gauges provide only ruler markings on the scribing bar that the user must rely on to position the bar with respect to the fence. Additionally, conventional marking gauges provide a single method of adjusting the scribing bar (i.e., manually sliding the bar with respect to the fence) which can impair a user's ability to precisely position the scribing bar.

SUMMARY

In one aspect, a tool for acting on a workpiece generally comprises a body and an adjustable element movably attached to the body. A tool member on the adjustable element is disposed on the adjustable element to act on the workpiece. The adjustable element is configured to move between a plurality of predetermined adjustment positions to locate a portion of the adjustable element a selected distance from the body. The adjustable element is resiliently biased against movement out of the predetermined adjustment positions. A micro adjustment mechanism provides for micro adjustment of a position of the adjustable element relative to the body once the adjustable element is moved to a selected predetermined adjustment position. The micro adjustment mechanism is configured for moving the adjustable element to an intermediate adjustment position located between the selected predetermined adjustment position and an immediately adjacent predetermined adjustment position for precise position adjustment of the adjustable element.

In another aspect, a method of adjusting a position of an adjustable element of a tool generally comprises moving the adjustable element attached to a body of the tool between a plurality of predetermined adjustment positions to locate a portion of the adjustable element a selected distance from the body. The adjustable element is resiliently biased against movement out of the predetermined adjustment positions. The method further comprises moving the adjustable element with a micro adjustment mechanism of the tool providing for micro adjustment of a position of the adjustable element relative to the body once the adjustable element is moved to a selected predetermined adjustment position. The micro adjustment mechanism adjusts the adjustable element to an intermediate adjustment position located between the selected predetermined adjustment position and an immediately adjacent predetermined adjustment position for precise position adjustment of the adjustable element.

In yet another aspect, a marking gauge generally comprises a gauge body and a fence on the gauge body including an engagement surface for engaging an edge of a workpiece during use of the gauge. A guide shaft is movably attached to the gauge body. The guide shaft is configured to move between a plurality of predetermined adjustment positions to locate a distal end of the guide shaft a selected distance from the fence. The guide shaft is resiliently biased against movement out of the predetermined adjustment positions. A micro adjustment mechanism provides for micro adjustment of a position of the guide shaft relative to the gauge body once the guide shaft is moved to a selected predetermined adjustment position. The micro adjustment mechanism is configured for moving the guide shaft to an intermediate adjustment position located between the selected predetermined adjustment position and an immediately adjacent predetermined adjustment position for precise position adjustment of the guide shaft. A blade is attached to the guide shaft for scribing a line in the workpiece a distance from the edge of the workpiece corresponding to the precise position adjustment of the guide shaft when the fence is engaged with the edge of the workpiece and moved along the edge of the workpiece.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
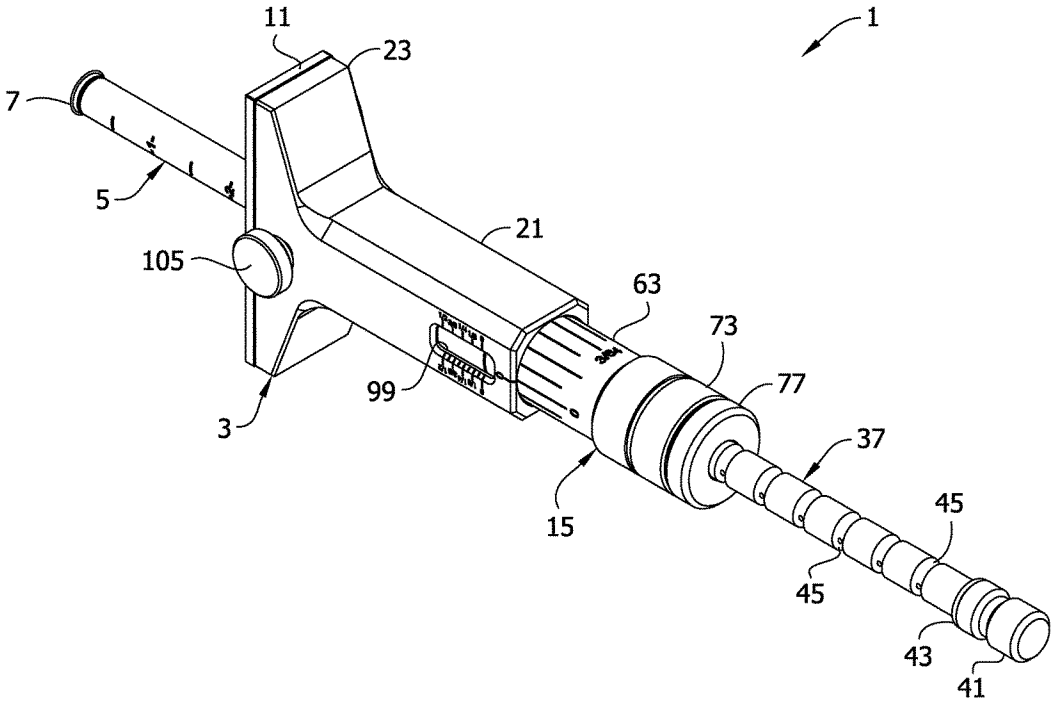
FIG. 1 is a perspective of a marking gauge.
Figure 2:
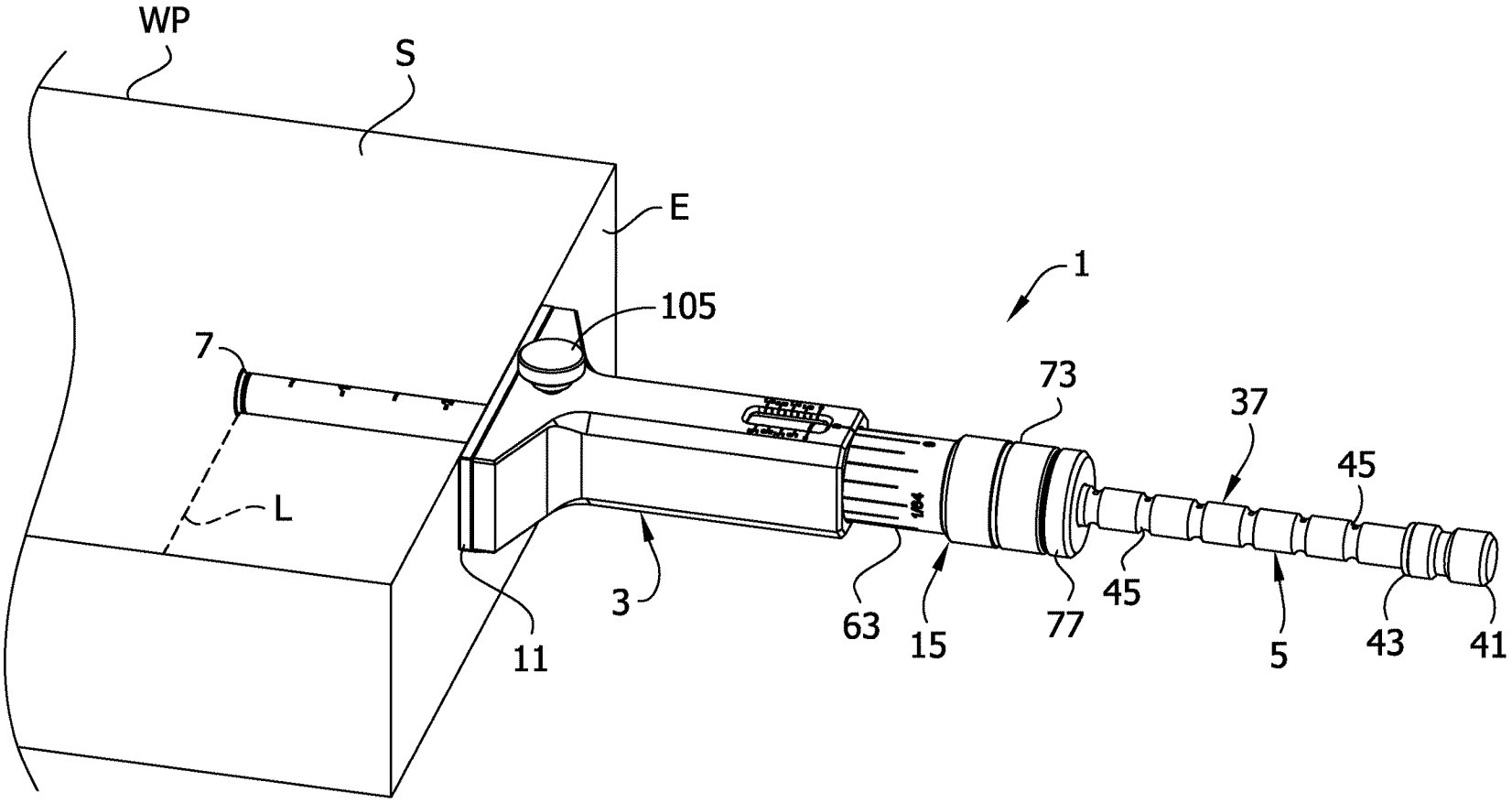
FIG. 2 is an illustration of the marking gauge scribing a line in a workpiece.
Figure 3:
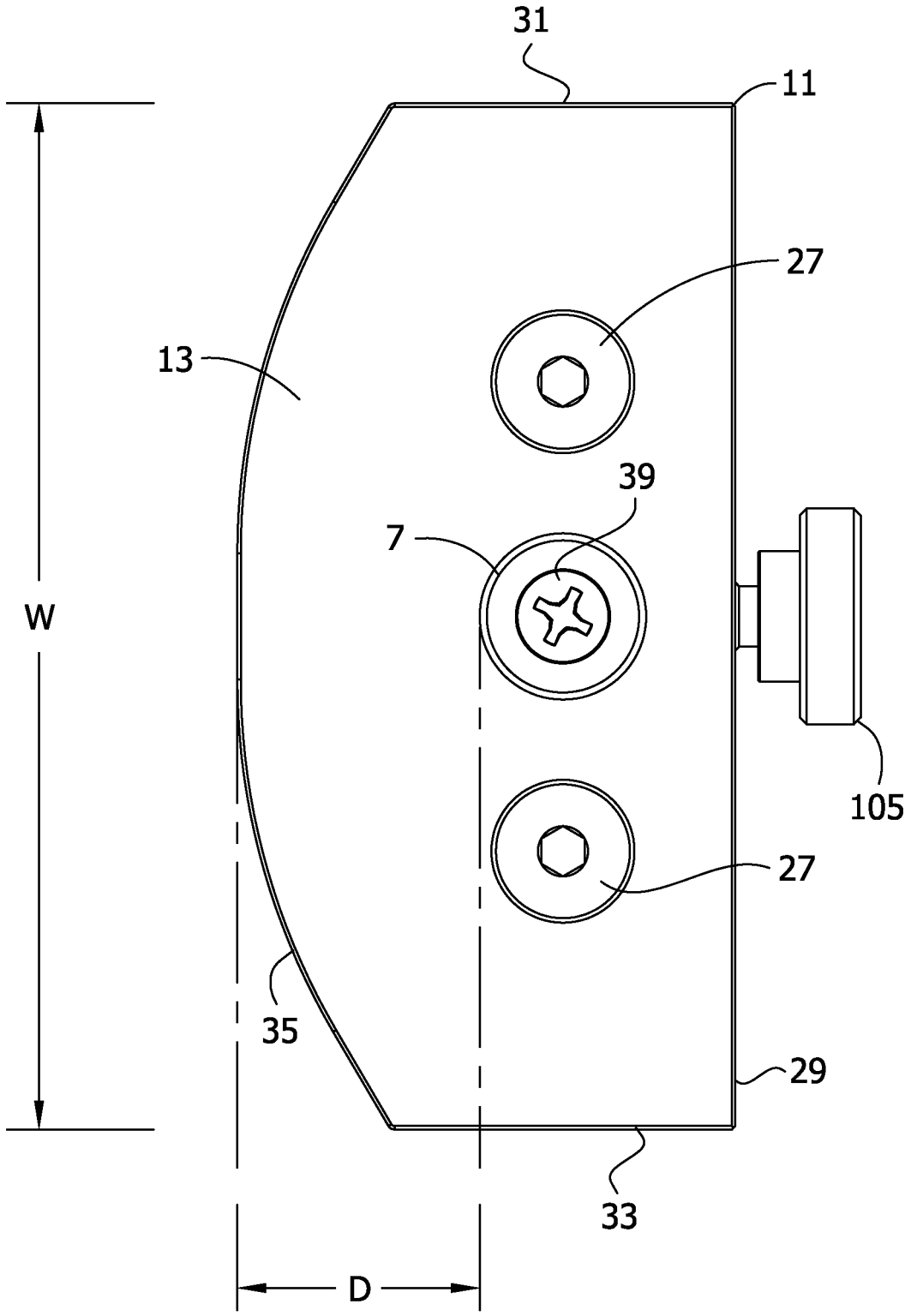
FIG. 3 is a left end view of the marking gauge.

Referring now to the drawings and in particular to FIGS. 1-3, a marking gauge, generally indicated at 1, for use in scribing a line L in a workpiece WP (FIG. 2) is illustrated. The gauge 1 includes a body 3 and a guide shaft 5 slideably attached to the body. A blade 7 (broadly, "a tool member") is attached to a distal end of the guide shaft 5. A fence 11 is fixedly attached to the body 3 and includes an engagement surface 13 (FIG. 3) for engaging and sliding along an edge E of the workpiece WP to scribe the line L in a side S of the workpiece with the blade 7. The guide shaft 5 can be adjusted relative to the body 3 to locate the blade 7 at a precise selected distance from the engagement surface 13 of the fence 11 (FIGS. 4-6), and hence from the edge E of the workpiece WP engaged by the fence. As will be explained in greater detail below, the marking gauge 1 includes a macro adjustment feature wherein the guide shaft 5 can be moved relative to the body 3 between a plurality of predetermined adjustment positions spaced along a length of the guide shaft 5, and a micro adjustment feature including a micro adjustment mechanism 15 configured to move the guide shaft relative to the body to a plurality of intermediate adjustment positions between two adjacent predetermined adjustment positions. The macro and micro adjustment capabilities of the marking gauge 1 allow the gauge to be quickly adjusted to or near a desired position, and then easily further adjusted, if necessary, using the micro adjustment mechanism 15 to precisely adjust the gauge to a final selected adjustment position.

While the adjustment features are shown incorporated into a marking gauge, it is envisioned that the adjustment features could be used in other tools and devices to quickly and precisely adjust portions of the tool/device. For instance, and without limitation, the adjustment features could be incorporated into a router table fence for adjusting a position of the fence on a worktable, or a jig for adjusting a position of a drill guide of the jig relative to a workpiece. The marking gauge 1 of the illustrated embodiment is primarily used for wood working. However, it is envisioned that other materials can be worked by this tool.

Referring to FIGS. 1-3, 8, and 9, the body 3 of the marking gauge 1 comprises a narrow proximal portion 21 and a flared distal portion 23 extending from the narrow portion. A guide passage 25 extends through the body 3 and movably receives the guide shaft 5 and micro adjustment mechanism 15, as will be explained in greater detail below. The narrow proximal portion 21 provides a gripping surface for a user to grasp the gauge 1 during use. The fence 11 is attached to a distal end of the flared distal portion 23 of the body 3 by fasteners 27. The fence 11 includes a front edge 29 that is generally aligned with the front surface of the body 3, and top and bottom edges 31, 33 that are generally aligned with respective top and bottom surfaces of the body. A rear edge 35 of the fence 11 has a curved shape and extends away from a rear surface of the body 3 providing the fence with a larger profile than the distal portion 23 of the body. This larger profile provides an increased surface area for the engagement surface 13 of the fence 11 which allows a user to easily locate the gauge 1 with respect to the workpiece WP during use. In one embodiment, the fence 11 has a width W of about 3 inches, and a dimension D extending from the bottom of the blade 7 to the rear edge 35 of the fence of about ¾ of an inch. It is envisioned that the fence 11 could have other dimensions without departing from the scope of the disclosure. The fence 11 may be formed from stainless steel. However, the fence 11 could be formed from other materials without departing from the scope of the disclosure. While the illustrated embodiment shows the fence 11 as a separate component from the body 3 and attached to the body by fasteners 27, it is envisioned that the fence could be formed as one piece with the body.

Figure 4:
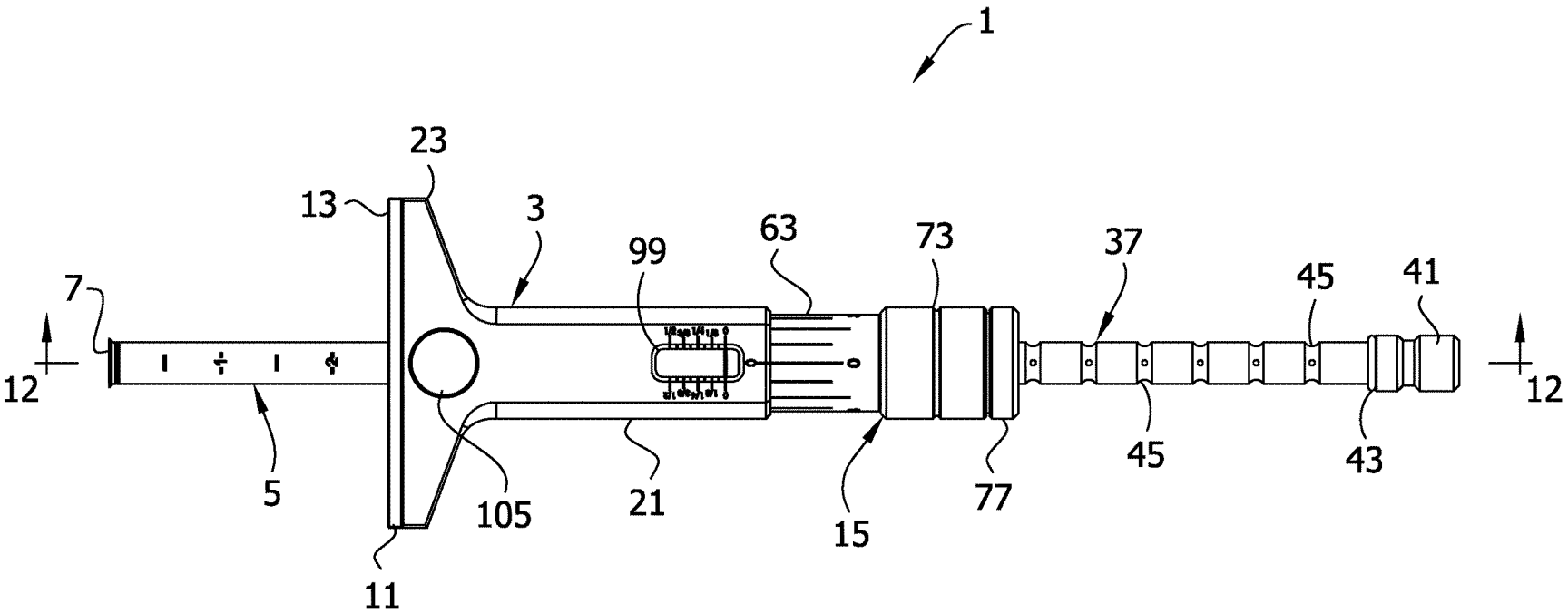
FIG. 4 is a front view of the marking gauge showing a guide shaft of the gauge in a first predetermined adjustment position.
Figure 5:
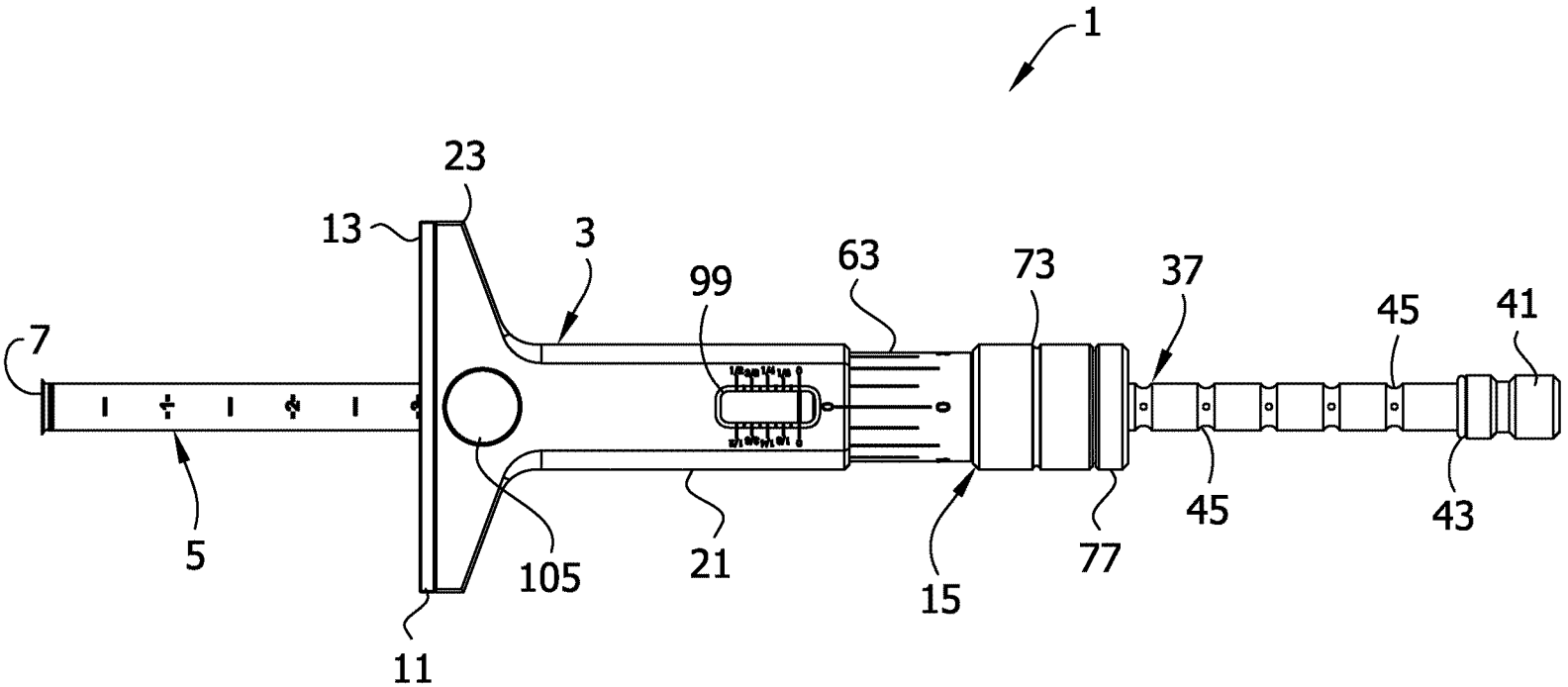
FIG. 5 is a front view of the marking gauge showing the guide shaft in a second predetermined adjustment position.
Figure 6:
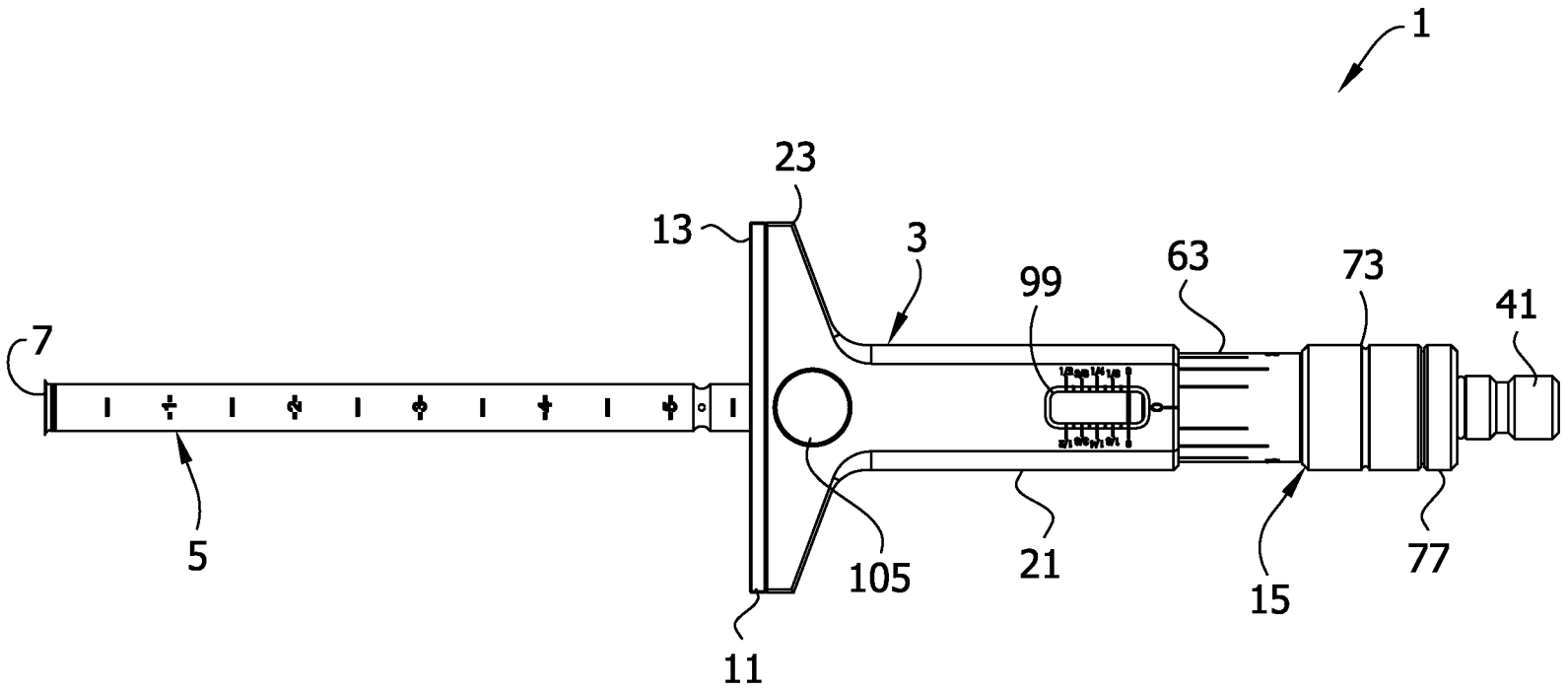
FIG. 6 is a front view of the marking gauge showing the guide shaft in a third predetermined adjustment position.
Figure 8:
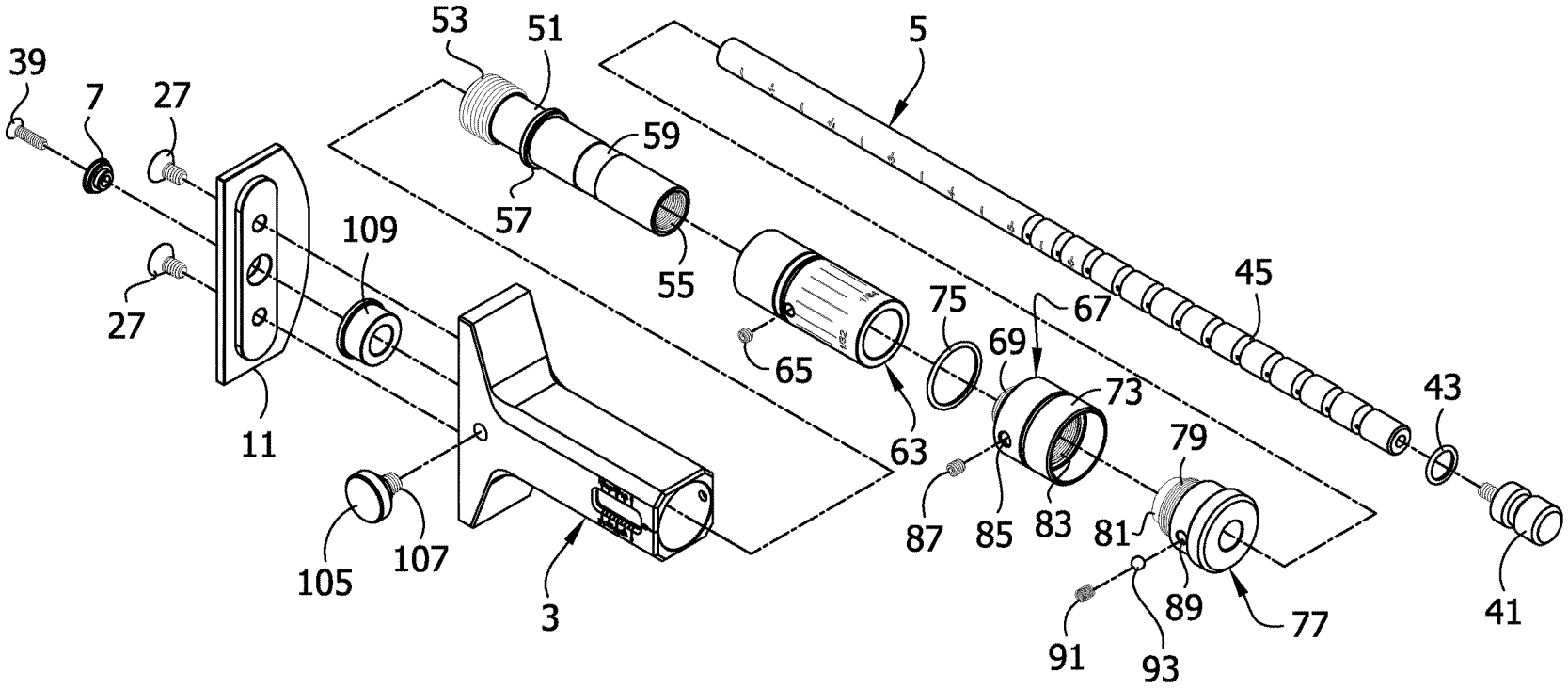
FIG. 8 is an exploded view of the marking gauge.
Figure 9:
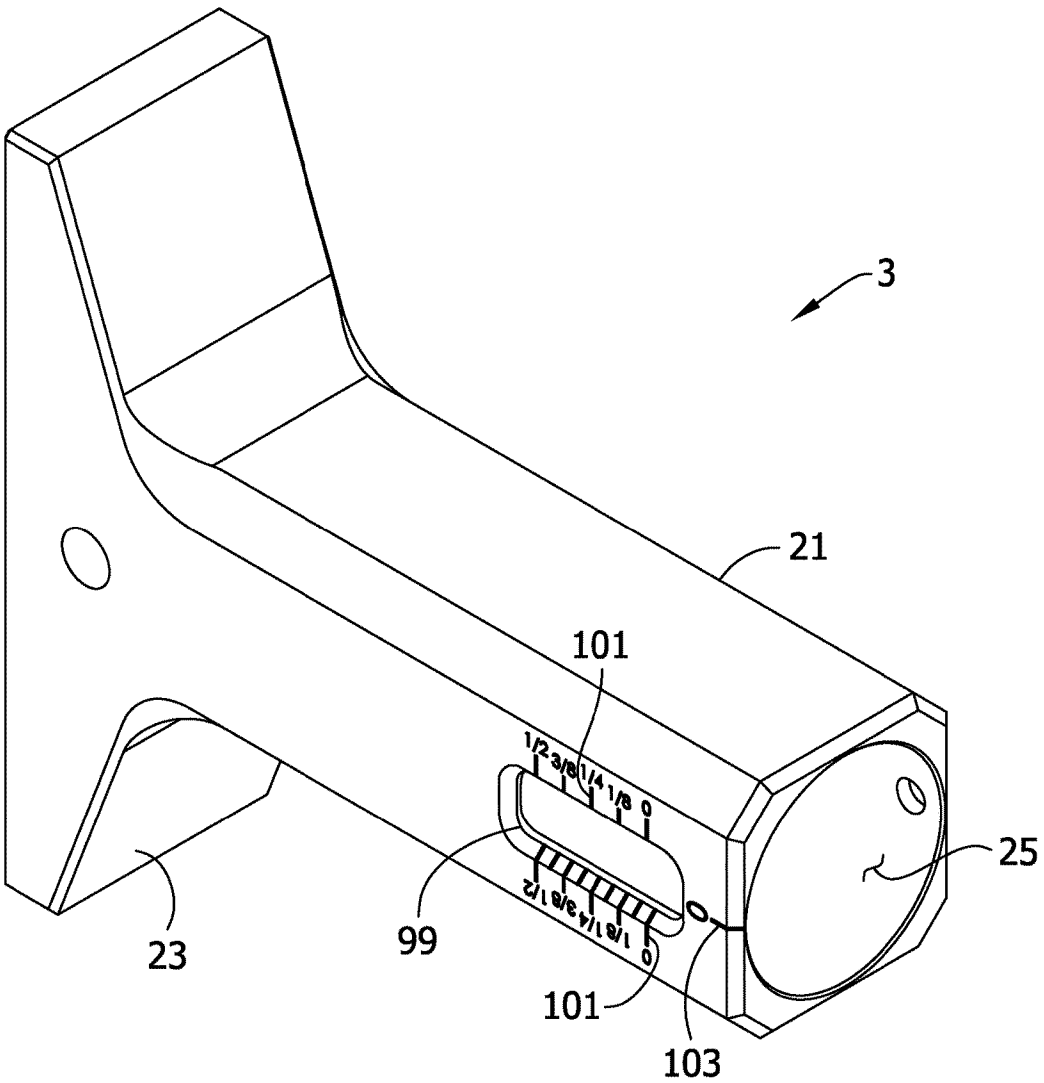
FIG. 9 is a perspective of a body of the marking gauge.
Figure 10:
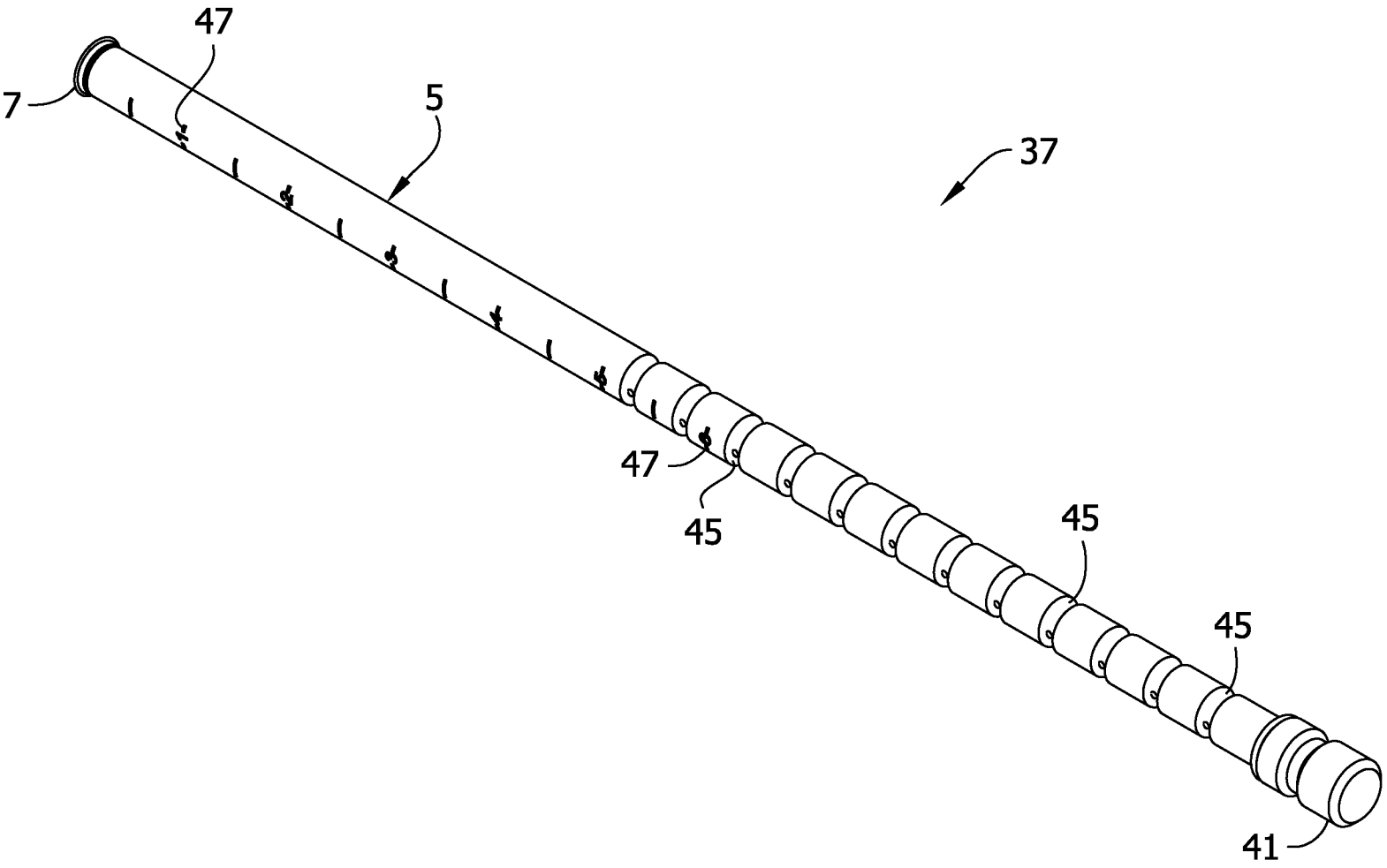
FIG. 10 is a perspective of a guide shaft assembly of the marking gauge.

Referring to FIGS. 8 and 10, a guide shaft assembly 37 includes the guide shaft 5 and the blade 7 attached to the distal end of the guide shaft by a fastener 39. The blade 7 can be made from A2 tool steel. However, other materials are envisioned without departing from the scope of the disclosure. The guide shaft assembly 37 further includes a stop 41 attached to a proximal end of the guide shaft 5 and a ring member 43 disposed between the stop and the guide shaft proximal end. The guide shaft 5 includes a plurality of circumferential grooves 45 spaced along a length of the guide shaft. In one embodiment, the grooves 45 are spaced ½ inch apart along the length of the guide shaft 5. Indicia 47 on the guide shaft 5 corresponds to the grooves 45 and provides an indication to the user of a distance the blade 7 is spaced from the engagement surface 13 of the fence 11 (FIGS. 4-6). In the illustrated embodiment, the indicia 47 comprises graduations spaced at ½ inch intervals, and corresponding numbers from 1 to 6 at each inch mark. In the illustrated embodiment, there are 12 grooves 45 that provide a total of 6 inches of adjustment for the guide shaft assembly 37. However, any number of grooves spaced at any selected interval may be provided without departing from the scope of the disclosure.

As a result of the fastener connection between the guide shaft 5 and the blade 7, and the threaded connection between the guide shaft and the stop 41, the components of the guide shaft assembly 37 are fixedly attached to each other such that they all move conjointly. The guide shaft assembly 37 is slideably received in the micro adjustment assembly 15 and the body 3 for moving the guide shaft 5 relative to the micro adjustment assembly and body. Each groove 45 in the guide shaft 5 corresponds to a predetermined adjustment position of the guide shaft assembly 37. As will be explained in greater detail below, sliding the guide shaft assembly 37 through the micro adjustment mechanism 15 and body 3 moves the guide shaft 5 between the predetermined macro adjustment positions.

Referring to FIGS. 8 and 11-13, the micro adjustment mechanism 15 is disposed in the guide passage 25 in the body 3. The micro adjustment mechanism 15 comprises a tubular link member 51 including external threads 53 at a distal end of the link member and internal threads 55 at a proximal end of the link member. A collar 57 is disposed around an outer surface of the link member 51 near the distal end of the link member, and an annular recessed portion 59 is formed in the outer surface of the link member 51 between the collar and the proximal end of the link member. The external threads 53 on the link member 51 engage internal threads 61 on the body 3 to facilitate movement of the micro adjustment mechanism 15 relative to the body, as will be explained in greater detail below.

A tubular dial 63 is received around the link member 51 and is fixedly attached to the link member by a set screw 65 preventing relative rotation between the dial and the link member. The tubular dial 63 is positioned around the link member 51 by seating a distal end of the dial against the collar 57 on the link member. The set screw 65 is threaded into a side of the dial 63 and engages the link member 51 in the recessed portion 59 fixedly attaching the dial to the link member. In this position, the proximal ends of the dial 63 and link member 51 are generally flush with each other.

A tubular retainer 67 comprises external threads 69 at a distal end of the retainer that engage the internal threads 55 at the proximal end of the link member 51. The retainer 67 further includes a shoulder 71 near the distal end of the retainer and an annular wall 73 at the proximal end of the retainer. A ring member 75 is disposed in a circumferential recess in an outer surface of the dial 63 between the dial and an inner surface of the body 3. Ring member 75 fills a gap between the outer surface of the dial 63 and the inner surface of the body 3 and keeps the dial spaced from the body so the body and dial do not wear from contacting each other during use of the gauge 1.

A tubular mount 77 includes external threads 79 spaced from a distal end of the mount by an unthreaded end portion 81. The external threads 79 engage internal threads 83 on the retainer 67 to attach the mount to the retainer. An opening 85 in a side of the retainer 67 receives a set screw 87 for engaging the end portion 81 of the mount 77 to prevent relative rotation between the retainer and the mount. As a result of the threaded connections between the link member 51, retainer 67, and mount 77, and the set screws 65, 87 attaching the dial 63 to the link member, and the retainer to the mount, the components of the micro adjustment mechanism 15 are all fixedly attached to each other such that they move conjointly with each other. Thus, rotation of the mount 77 causes conjoint rotation of the link member 51 which causes the external threads 53 on the link member to move along the internal threads 61 on the body 3 resulting in the axial movement of the micro adjustment mechanism 15 relative to the body 3. Further, the tubular construction of the components of the micro adjustment mechanism 15 allow the mechanism to receive the guide shaft 5 of the guide shaft assembly 37 and permit sliding movement of the guide shaft through the mechanism.

Figure 12:
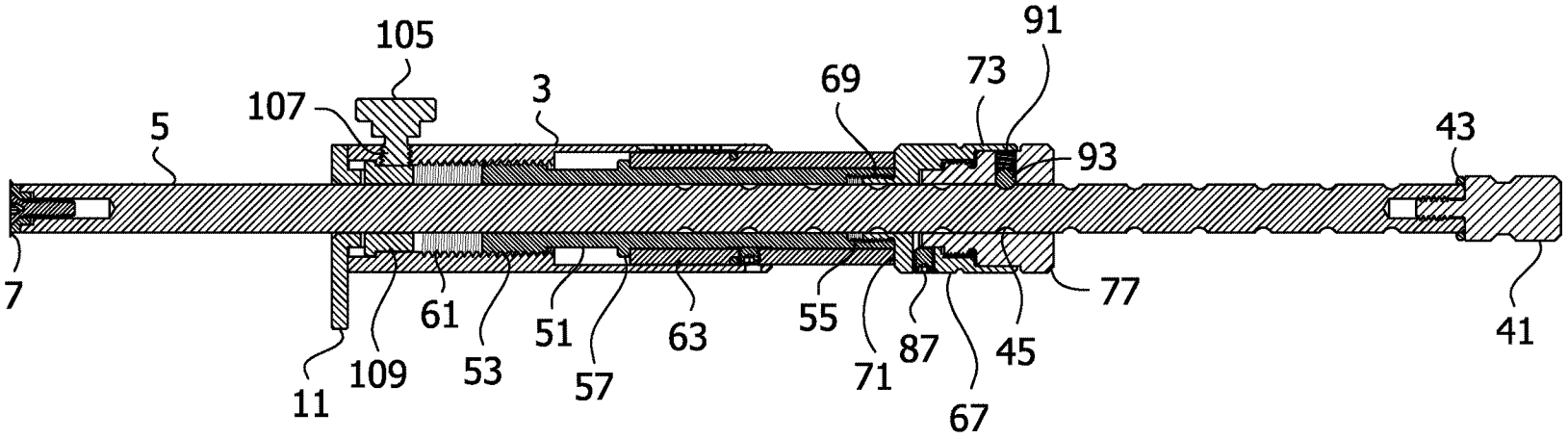
FIG. 12 is a cross section of the marking gauge taken through line 12-12 in FIG. 4.
Figure 13:
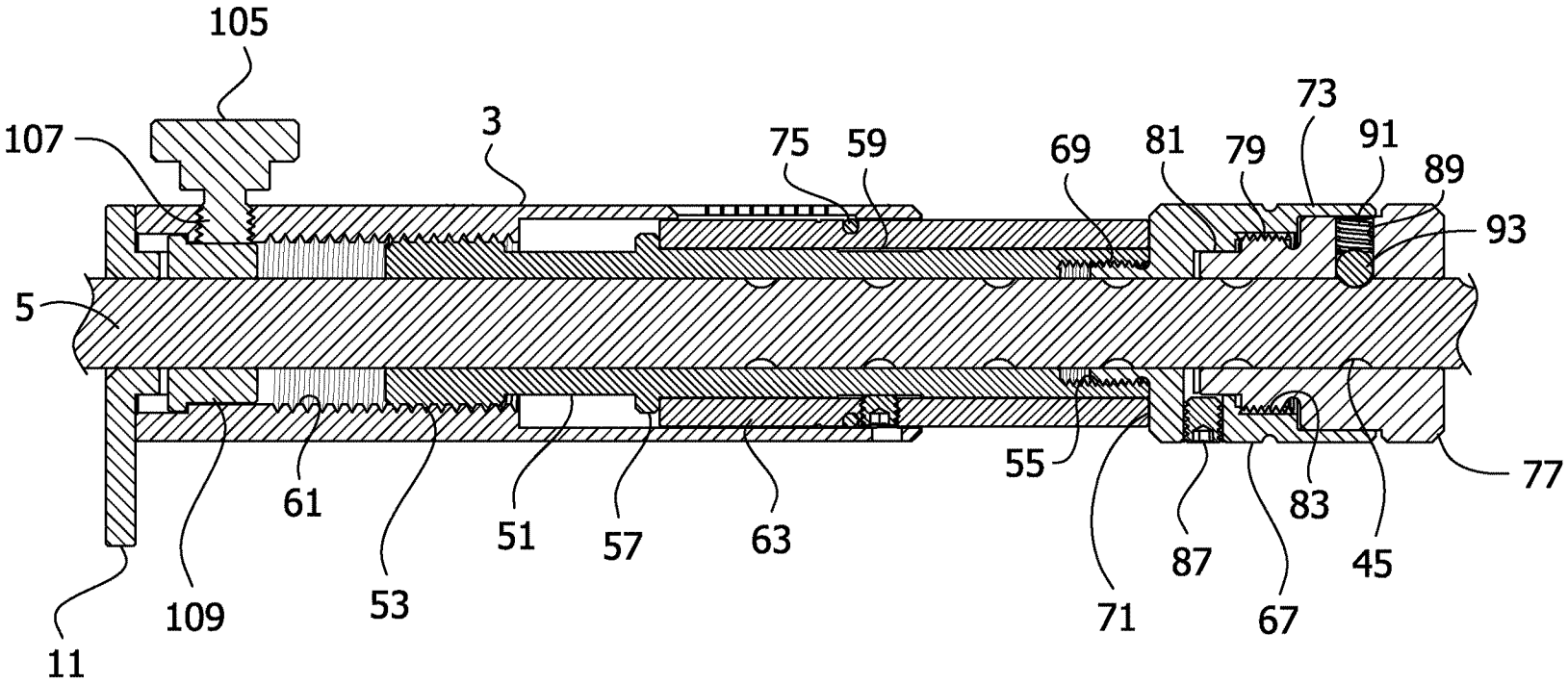
FIG. 13 is an enlarged fragmentary view of FIG. 12.
Figure 14:
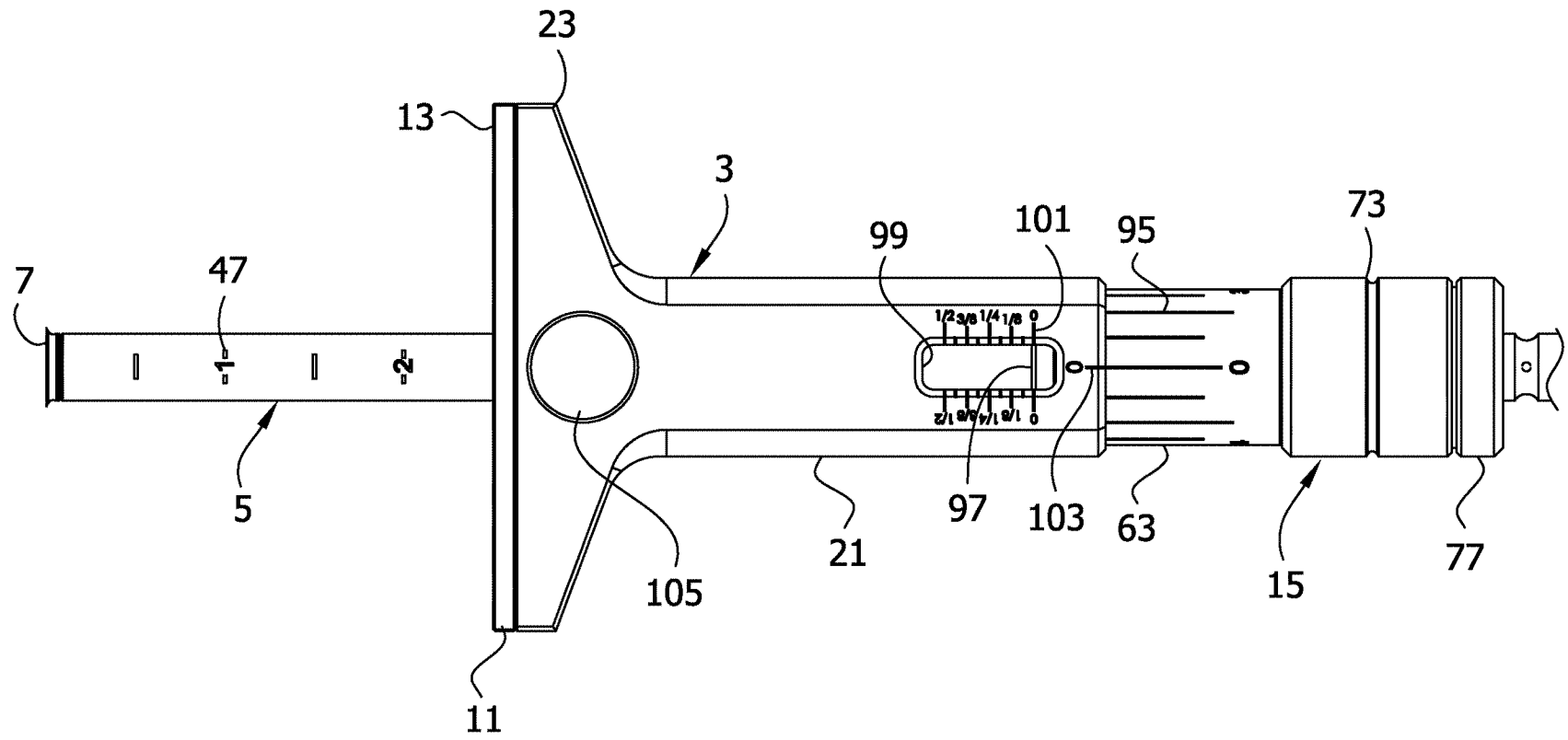
FIG. 14 is an enlarged fragmentary view of FIG. 4.

The tubular mount 77 has an opening 89 in a side of the mount. The opening 89 is sized to partially house a spring 91 and detent ball 93. The annular wall 73 of the retainer 67 defines a cup that receives a portion of the tubular mount 77 including the opening 89. As a result, spring 91 bears against an inner surface of the annular wall 73 and biases the detent 93 into contact with the guide shaft 5. As shown in FIGS. 12 and 13, the detent 93 can be biased into engagement with one of the grooves 45 in the guide shaft 5. This configuration releasably positions the guide shaft assembly 37 relative to the micro adjustment mechanism 15 and body 3.

Figure 11:
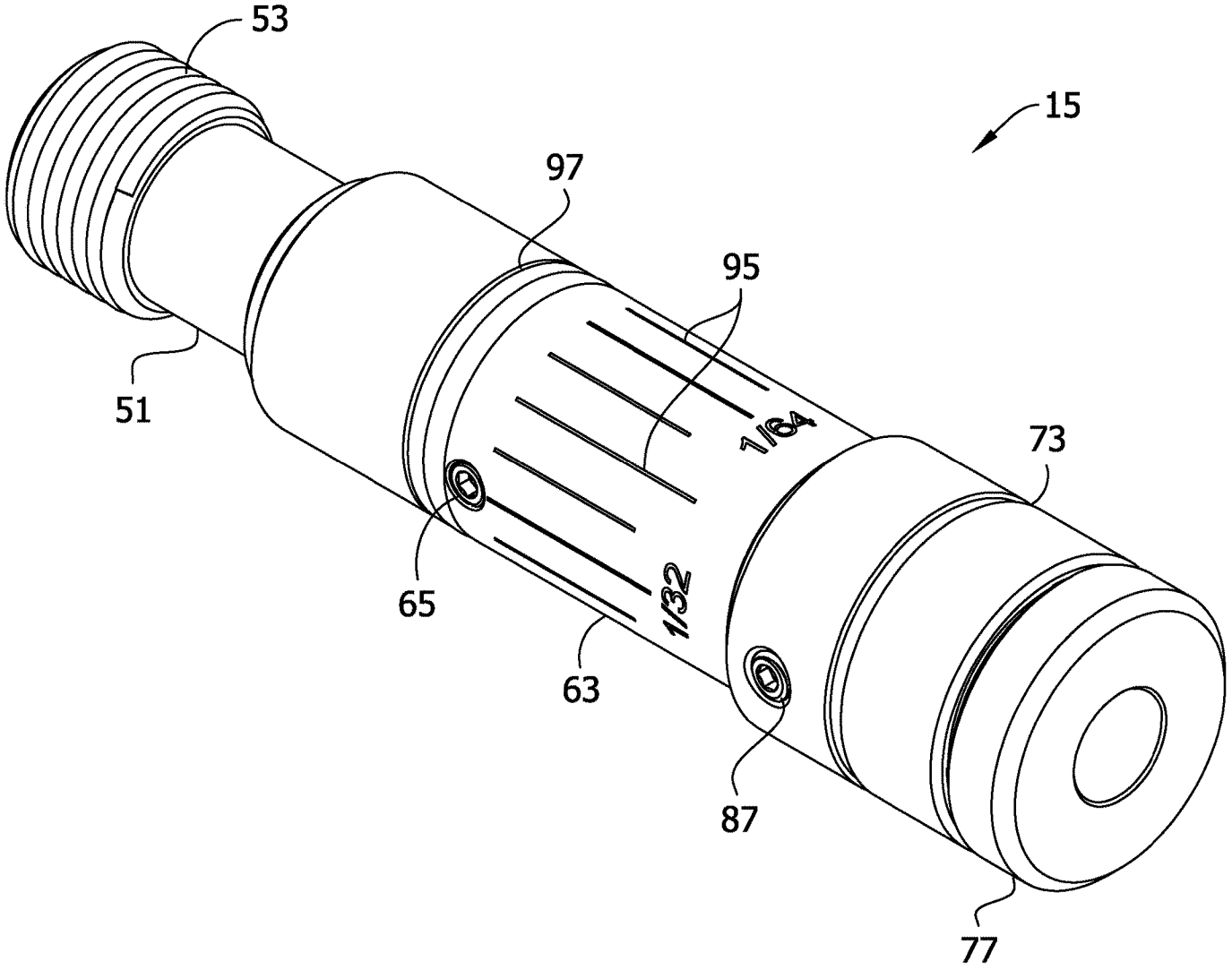
FIG. 11 is a perspective of a micro adjustment mechanism of the marking gauge.

Referring to FIGS. 1 and 8-11, the dial 63 has indicia including graduations 95 circumferentially spaced around the dial and an indicator line 97 extending circumferentially around the dial (FIG. 11). Each graduation 95 indicates 1/256th of an inch, and the graduations on the dial are numbered every 1/32nd of an inch. The body 3 has a window 99 in the narrow portion 21 and graduations 101 located next to the window. Each graduation 101 on the body 3 indicates 1/16th of an inch increment, and the graduations on the body are numbered every 1/8th of an inch. An indicator line 103 on the body 3 is disposed at the proximal end of the body and is configured to align with the graduations 95 on the dial 63 as the micro adjustment mechanism 15, including the dial, is rotated. The graduations 101 on the body 3 correspond to the graduations 95 on the dial 63 so that the indicia on the body provide a visual indication of the degree of micro adjustment imparted by the micro adjustment mechanism 15.

Referring to FIGS. 2, 4-6, 11, and 14-17, the guide shaft assembly 37 can be adjusted to a selected position to locate the blade 7 at a desired length from the engagement surface 13 of the fence 11 for scribing a line L in the workpiece WP. The adjustment of the guide shaft assembly 37 can be performed in two steps. The first step is the "macro adjustment" step wherein the guide shaft assembly 37 is slid relative to the body 3 to position the guide shaft 5 at one of a plurality of predetermined adjustment positions defined by the locations of the grooves 45 in the guide shaft.

To perform the macro adjustment of the gauge 1, the guide shaft 5 is slid through the tubular components of the micro adjustment mechanism 15. As the guide shaft 5 is slid through the micro adjustment mechanism 15, the detent 93 removably engages the grooves 45 in the guide shaft releasably securing the guide shaft in position relative to the body 3. Sliding the guide shaft assembly 37 to the left, as shown from the perspective of FIGS. 4-6, moves the blade 7 away from the fence 11, and sliding the guide shaft assembly to the right, as shown in the perspective of FIGS. 4-6, moves the blade toward the fence. The guide shaft assembly 37 is adjusted by applying sufficient force to overcome the bias of the spring 91 that urges the detent 93 into engagement with a respective groove 45. Once a sufficient amount of force is applied, the detent 93 is moved out of the groove 45 and the guide shaft 5 is free to move with respect to the detent until the detent comes into registration with the next groove. At this point, the force exerted by the spring 91 urges the detent 93 into the next groove 45, releasably holding the guide shaft in position. In one embodiment, about 25% of the detent's diameter is received in the groove 45 so that the detent 93 is held securely in the groove but can be moved out of the groove without excessive force.

Figure 7:
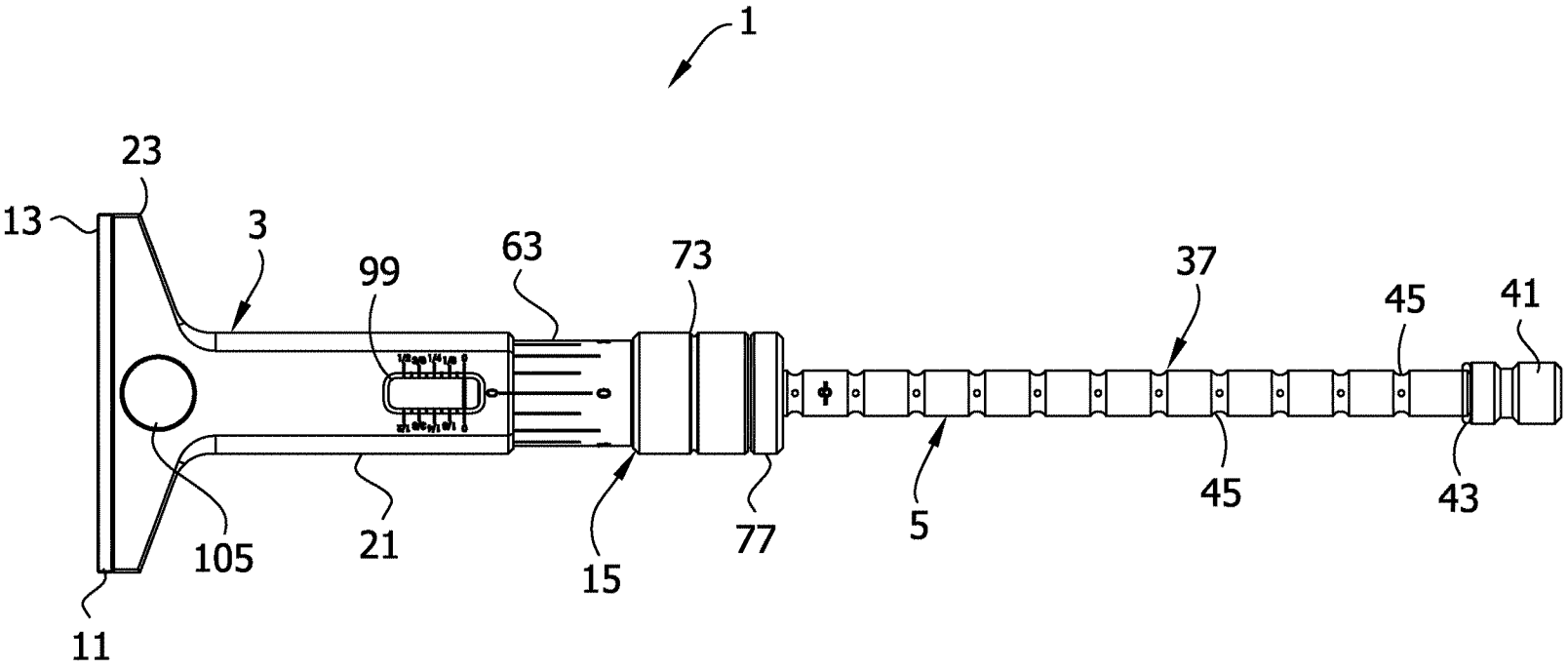
FIG. 7 is a front view of the marking gauge showing the guide shaft in a fourth predetermined adjustment position.

Broadly, registration of the detent 93 with a groove 45 corresponds to a predetermined adjustment position of the guide shaft assembly 37. The grooves 45 are spaced ½ inch away from each other so a user can adjust the position of the guide shaft assembly 37 in ½ inch increments. For example, as shown in FIGS. 4 and 5, the guide shaft assembly 37 can be moved from one predetermined adjustment position (2½ inch mark) to an adjacent predetermined adjustment position (3 inch mark). FIG. 6 shows the guide shaft assembly 37 moved all the way to the left, engaging the stop 41 with the mount 77 and fully extending the guide shaft 5 from the fence 11. In this position, the ring member 43 acts as a buffer between the stop 41 and the mount so that the stop and mount 77 are not damaged during use of the gauge 1. FIG. 7 show the guide shaft assembly 37 moved all the way to the right, fully retracting the blade 7 into the fence 11.

Figure 15:
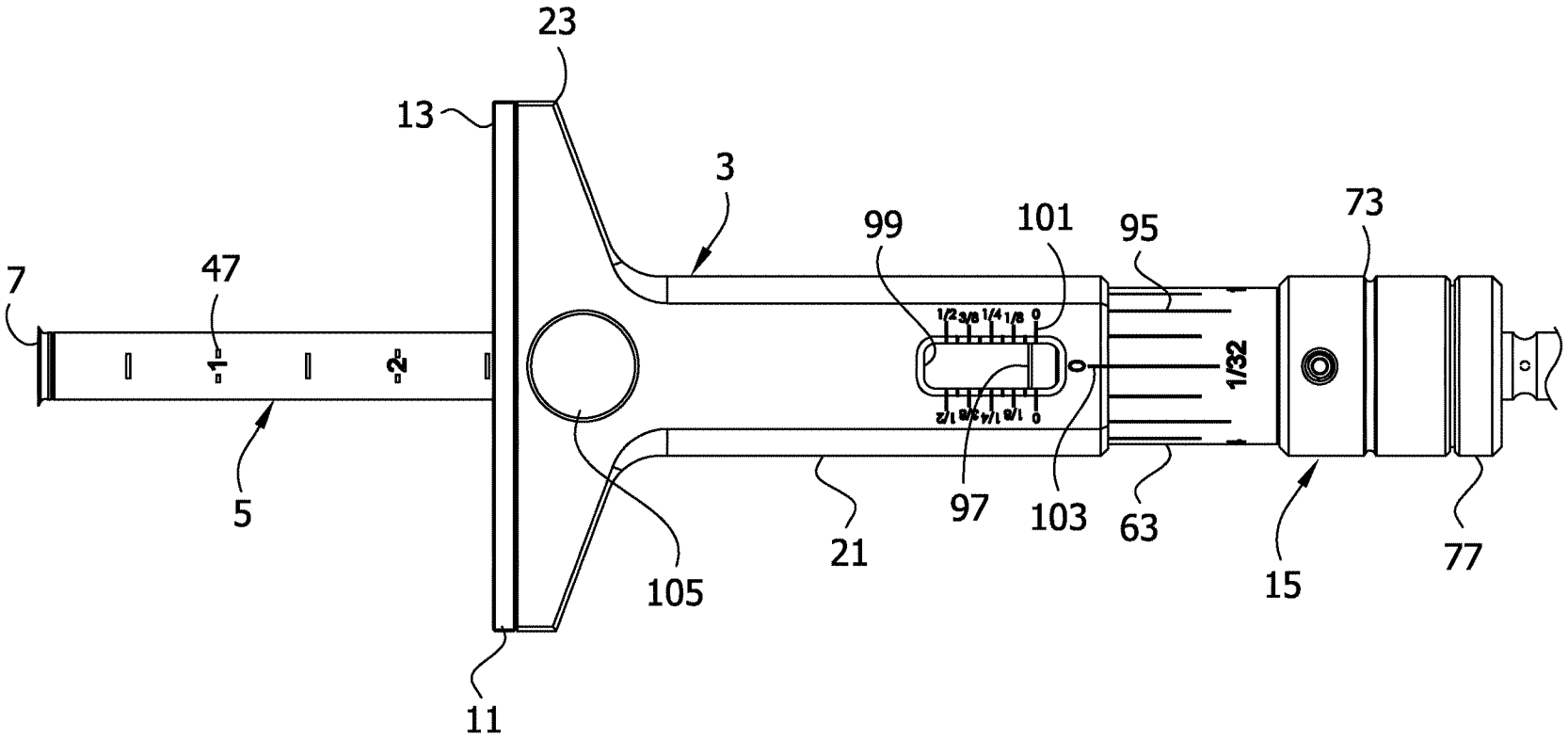
FIG. 15 is the enlarged fragmentary view of FIG. 14 showing the guide shaft in a first intermediate adjustment position.
Figure 16:
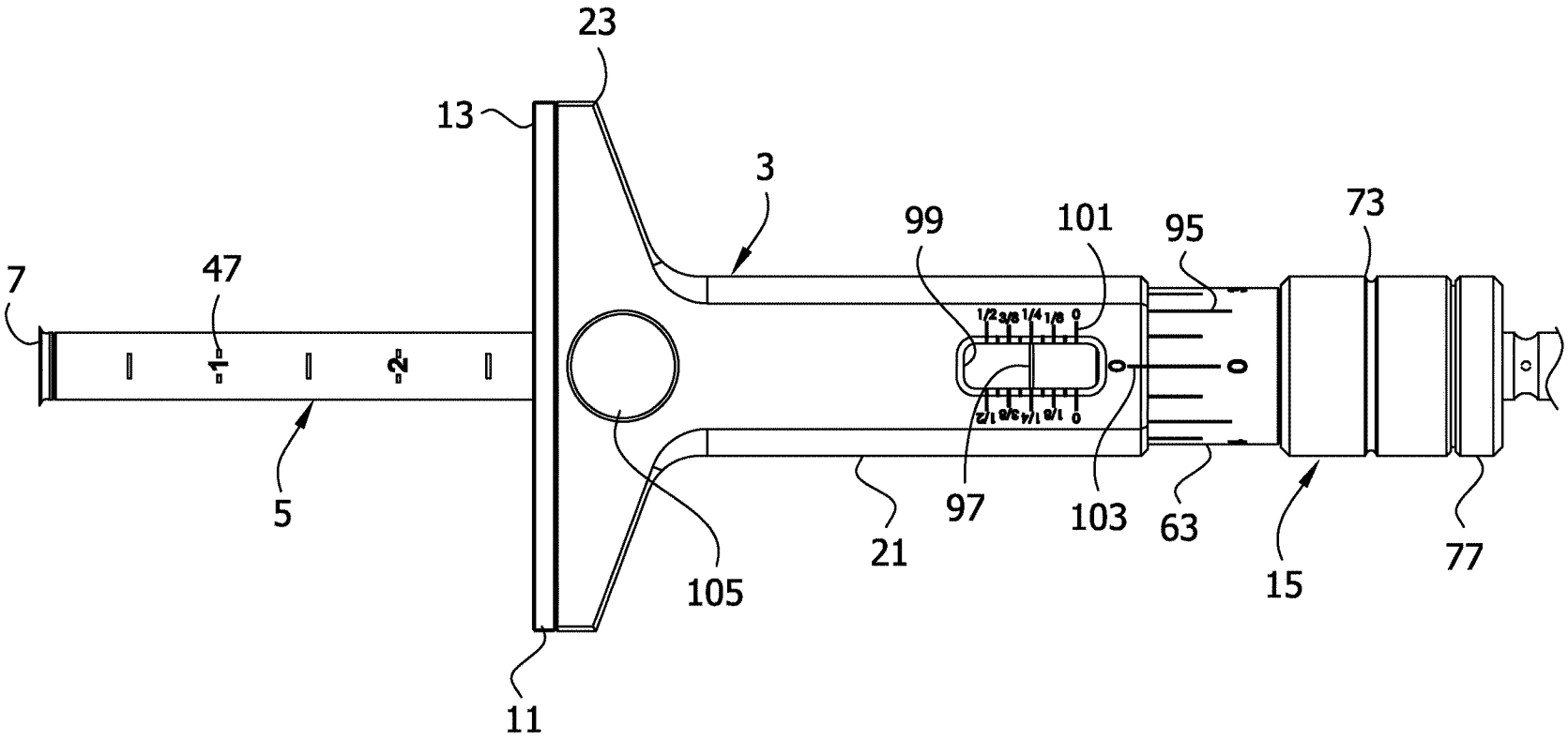
FIG. 16 is the enlarged fragmentary view of FIG. 14 showing the guide shaft in a second intermediate adjustment position.
Figure 17:
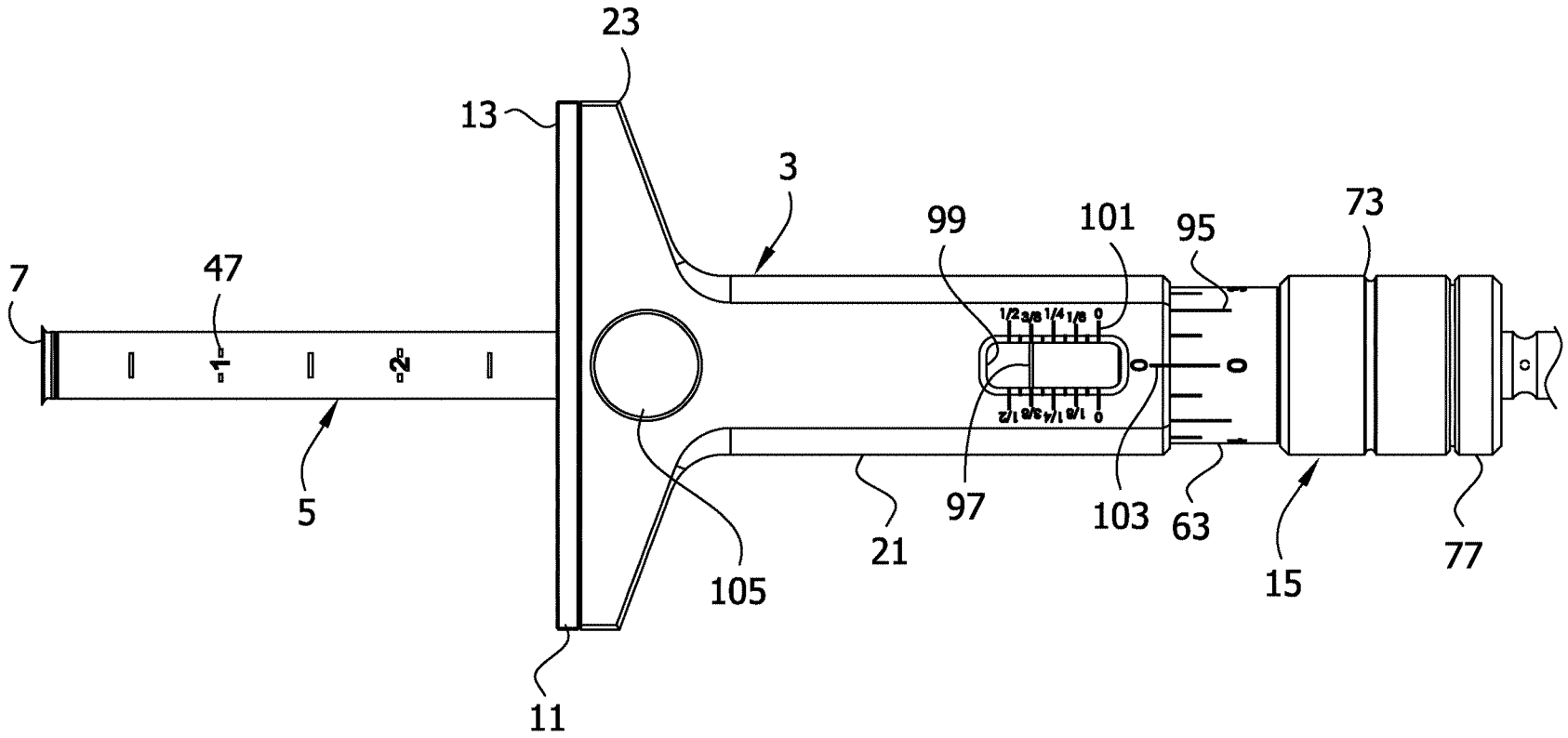
FIG. 17 is the enlarged fragmentary view of FIG. 14 showing the guide shaft in a third intermediate adjustment position.

If it is desired, the micro adjustment mechanism 15 may then be rotated to further adjust the guide shaft assembly 37 relative to the body 3 to a position between two adjacent predetermined (½ inch) adjustment positions (grooves 45). In one embodiment, the pitch of the threaded connection between the body 3 and the micro adjustment mechanism 15 is configured such that one full rotation of the micro adjustment mechanism advances the micro adjustment mechanism 1/16th of an inch relative to the body. Referring to FIGS. 15-17, the marking gauge 1 is illustrated in a series of intermediate adjustment positions between the predetermined adjustment positions associated with the 2½ and 3 inch marks.

In a first intermediate adjustment position (FIG. 15), the micro adjustment mechanism 15 has been rotated one half rotation aligning the 1/32 graduation 95 on the dial 63 with the indicator line 103 on the body 3. Because of threaded connection between the micro adjustment mechanism 15 and the body 3, the micro adjustment mechanism translates relative to the body a distance of 1/32nd of an inch. Further, because the guide shaft assembly 37 is held fixed relative to the micro adjustment mechanism 15 by the detent 93, the guide shaft assembly moves in concert with the micro adjustment mechanism and is therefore also advanced 1/32nd of an inch. Thus, in the configuration illustrated in FIG. 15, the blade 7 is adjusted to a position of $2^{17}/_{32}$ inches from the engagement surface 13 of the fence 11.

In a second intermediate adjustment position (FIG. 16), the micro adjustment mechanism 15 has been rotated four full rotations aligning the 0 graduation 95 on the dial 63 with the indicator line 103 on the body 3. Four full rotations of the micro adjustment mechanism 15 advance the guide shaft assembly 37 ¼ of an inch relative to the body 3. Thus, in the configuration illustrated in FIG. 16, the blade 7 has been adjusted to about 2.75 inches from the engagement surface 13 of the fence 11.

In a third intermediate adjustment position (FIG. 17), the micro adjustment mechanism 15 has been rotated six full rotations aligning the 0 graduation 95 on the dial 63 with the indicator line 103 on the body 3. Six full rotations of the micro adjustment mechanism 15 advance the guide shaft assembly 37 ⅜ of an inch relative to the body 3. Thus, in the configuration illustrated in FIG. 17, the blade 7 has been adjusted to about 2.875 inches from the engagement surface 13 of the fence 11.

Referring to FIGS. 1, 12, and 13, to lock the marking gauge 1 in the final selected adjustment position, a knob 105 with a threaded stem 107 can be rotated to engage the stem of the knob with a locking ring 109 disposed around the guide shaft 5. Engagement of the locking ring 109 by the stem 107 presses the locking ring against the guide shaft 5 locking the guide shaft in place relative to the body 3.

Once the marking gauge 1 is adjusted to the final adjustment position, the gauge can be used to scribe the line L in the side S of the workpiece WP by contacting the engagement surface 13 of the fence 11 with the edge E of the workpiece and sliding the fence along the edge (FIG. 2).

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A tool for acting on a workpiece, the tool comprising:
a body;
an adjustable element movably attached to the body;
a tool member on the adjustable element disposed on the adjustable element to act on the workpiece;
the adjustable element being configured to move between a plurality of predetermined adjustment positions to locate a portion of the adjustable element a selected distance from the body, the adjustable element being resiliently biased against movement out of the predetermined adjustment positions; and
a micro adjustment mechanism providing for micro adjustment of a position of the adjustable element relative to the body once the adjustable element is moved to a selected predetermined adjustment position, the micro adjustment mechanism configured for moving the adjustable element to an intermediate adjustment position located between the selected predetermined adjustment position and an immediately adjacent predetermined adjustment position for precise position adjustment of the adjustable element, wherein the adjustable element includes a plurality of grooves spaced along the adjustable element, each groove corresponding to a predetermined adjustment position.

2. The tool of claim 1, further comprising a detent resiliently biased for engagement with the grooves, engagement of the detent with one of the grooves positions the adjustable element in the corresponding predetermined adjustment position.

3. The tool of claim 1, wherein the adjustment element includes indicia corresponding to the grooves for indicating to a user the selected predetermined adjustment position.

4. The tool of claim 1, wherein the micro adjustment mechanism is operatively connected to the body such that rotation of the micro adjustment mechanism causes translation of the adjustable element relative to the body.

5. The tool of claim 4, wherein the micro adjustment mechanism is threadedly attached to the body.

6. The tool of claim 5, wherein the micro adjustment mechanism comprises a rotatable dial including graduations circumferentially spaced around the dial, the graduations indicating the distance the adjustable element is adjusted by rotation of the dial.

7. The tool of claim 6, wherein the body includes graduations generally corresponding to the graduations on the dial for indicating to a user the intermediate adjustment position of the adjustable element.

8. The device of claim 1, further comprising a lock configured to fix the position of the adjustable element relative to the body.

9. A method of adjusting a position of an adjustable element of a tool, the method comprising:
moving the adjustable element attached to a body of the tool between a plurality of predetermined adjustment positions to locate a portion of the adjustable element a selected distance from the body, the adjustable element being resiliently biased against movement out of the predetermined adjustment positions, wherein the adjustable element includes a plurality of grooves spaced along the adjustable element, each groove corresponding to a predetermined adjustment position; and
moving the adjustable element with a micro adjustment mechanism of the tool providing for micro adjustment of a position of the adjustable element relative to the body once the adjustable element is moved to a selected predetermined adjustment position, the micro adjustment mechanism adjusting the adjustable element to an intermediate adjustment position located between the selected predetermined adjustment position and an immediately adjacent predetermined adjustment position for precise position adjustment of the adjustable element.

10. The method of claim 9, wherein moving the adjustable element between the plurality of predetermined adjustment positions comprises sliding the adjustable element relative to the body.

11. The method of claim 10, wherein moving the adjustable element with a micro adjustment mechanism comprises rotating the micro adjustment mechanism to cause translational movement of the adjustable element relative to the body.

12. The method of claim 11, further comprising locking the adjustable element against movement relative to the body.

13. A marking gauge comprising:
a gauge body;
a fence on the gauge body including an engagement surface for engaging an edge of a workpiece during use of the gauge;

a guide shaft movably attached to the gauge body, the guide shaft being configured to move between a plurality of predetermined adjustment positions to locate a distal end of the guide shaft a selected distance from the fence, the guide shaft being resiliently biased against movement out of the predetermined adjustment positions;

a micro adjustment mechanism providing for micro adjustment of a position of the guide shaft relative to the gauge body once the guide shaft is moved to a selected predetermined adjustment position, the micro adjustment mechanism configured for moving the guide shaft to an intermediate adjustment position located between the selected predetermined adjustment position and an immediately adjacent predetermined adjustment position for precise position adjustment of the guide shaft; and a blade attached to the guide shaft for scribing a line in the workpiece a distance from the edge of the workpiece corresponding to the precise position adjustment of the guide shaft when the fence is engaged with the edge of the workpiece and moved along the edge of the workpiece;

wherein the guide shaft includes a plurality of grooves spaced along a length of the guide shaft, each groove corresponding to a predetermined adjustment position.

14. The gauge of claim 13, further comprising a detent resiliently biased for engagement with the grooves, engagement of the detent with one of the grooves positions the guide shaft in the corresponding predetermined adjustment position.

15. The gauge of claim 13, wherein the guide shaft includes indicia corresponding to the grooves for indicating to a user the selected predetermined adjustment position.

16. The gauge of claim 13, wherein the micro adjustment mechanism is operatively connected to the gauge body such that rotation of the micro adjustment mechanism causes translation of the guide shaft relative to the gauge body.

17. The gauge of claim 16, wherein the micro adjustment mechanism is threadedly attached to the gauge body.

18. The gauge of claim 17, wherein the micro adjustment mechanism comprises a rotatable dial including graduations circumferentially spaced around the dial, the graduations indicating the distance the guide shaft is adjusted by rotation of the dial.

19. The gauge of claim 18, wherein the gauge body includes graduations generally corresponding to the graduations on the dial for indicating to a user the intermediate adjustment position of the guide shaft.

20. The gauge of claim 13, wherein the blade is disposed proximal to the engagement surface of the fence.

21. The gauge of claim 13, further comprising a lock configured to fix the position of the guide shaft relative to the gauge body.

22. The gauge of claim 21, wherein the lock comprises a ring fixed to the gauge body and receiving the guide shaft, and a knob threadedly attached to the gauge body and engageable with the ring to press the ring into frictional engagement with the guide shaft to lock the guide shaft in place.

* * * * *